US010095185B2

(12) United States Patent
Behra

(10) Patent No.: US 10,095,185 B2
(45) Date of Patent: Oct. 9, 2018

(54) SAFETY MECHANISM FOR SELECTION AND/OR ACTUATION OF A TIMEPIECE STRIKING WORK

(71) Applicant: Blancpain SA, Le Brassus (CH)

(72) Inventor: Julien Behra, Morez (FR)

(73) Assignee: Blancpain SA, Le Brassus (CH)

( * ) Notice: Subject to any disclaimer, the term of this patent is extended or adjusted under 35 U.S.C. 154(b) by 88 days.

(21) Appl. No.: 15/142,608

(22) Filed: Apr. 29, 2016

(65) Prior Publication Data

US 2016/0342138 A1 Nov. 24, 2016

(30) Foreign Application Priority Data

May 21, 2015 (EP) ..... 15168700

(51) Int. Cl.
*G10K 1/07* (2006.01)
*G04B 23/02* (2006.01)
(Continued)

(52) U.S. Cl.
CPC ..... *G04B 21/10* (2013.01); *G04B 21/04* (2013.01); *G04B 21/06* (2013.01); *G04B 21/08* (2013.01);
(Continued)

(58) Field of Classification Search
CPC ..... G04B 21/00; G04B 21/04; G04B 21/06; G04B 21/08; G04B 21/10; G04B 21/12; G04B 23/026; G10K 1/072; G10K 1/074; G10K 1/076
See application file for complete search history.

(56) References Cited

U.S. PATENT DOCUMENTS 1,556,184 A * 10/1925 Volpo ..... G04B 21/12 368/268
2008/0144448 A1* 6/2008 Goeller ..... G04B 21/12 368/190
(Continued)

FOREIGN PATENT DOCUMENTS

CH 701200 A2 * 12/2010 ..... G04B 21/04
CH 710898 A2 * 9/2016 ..... G04B 21/12
(Continued)

OTHER PUBLICATIONS

European Search Report dated Feb. 1, 2016 in European application 15168700.1, filed on May 21, 2015 (with English Translation).
(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Timepiece striking mechanism including control means, releasable by a timepiece movement or by a user, and arranged to start a melody or striking sound, and melody selection means including a lever for selecting a selector mechanism arranged to allow the movement of a specific control-piece in order to perform a specific melody or striking sound, this striking mechanism including a safety mechanism for preventing the selection or the actuation of a melody or striking sound when a melody or striking sound is already being performed, this safety mechanism includes, for each control piece, a cam arranged to prevent the operation of the melody selection means by immobilizing the lever, when its control piece has started to perform a melody or striking sound.

10 Claims, 10 Drawing Sheets

(51) Int. Cl.

| | |
|---|---|
| ***G04B 21/04*** | (2006.01) |
| ***G04B 21/06*** | (2006.01) |
| ***G04B 21/08*** | (2006.01) |
| ***G04B 21/10*** | (2006.01) |
| ***G04B 21/12*** | (2006.01) |
| *G10K 1/072* | (2006.01) |
| *G10K 1/074* | (2006.01) |
| *G10K 1/076* | (2006.01) |

(52) U.S. Cl.
CPC ..... *G04B 21/12* (2013.01); *G04B 23/025* (2013.01); *G04B 23/026* (2013.01); *G10K 1/072* (2013.01); *G10K 1/074* (2013.01); *G10K 1/076* (2013.01)

(56) References Cited

U.S. PATENT DOCUMENTS

2008/0165630 A1* 7/2008 Candaux ..... G04B 21/08 368/243
2010/0054091 A1* 3/2010 Schiesser ..... G04B 13/008 368/269
2011/0110200 A1* 5/2011 Goeller ..... G04B 21/08 368/243
2012/0230165 A1* 9/2012 Goeller ..... G04B 21/12 368/267
2016/0282815 A1* 9/2016 Orny ..... G04B 19/202

FOREIGN PATENT DOCUMENTS

EP 1 760 550 A1 3/2007
EP 1 770 453 B1 4/2007
EP 1 925 995 B1 5/2008
EP 2 498 148 A1 9/2012

OTHER PUBLICATIONS

Richard Watkins, "The Repeater", http://www.watkinsr.id.au/Repeater.pdf, Dec. 31, 2011, 88 Pages.

* cited by examiner

SAFETY MECHANISM FOR SELECTION AND/OR ACTUATION OF A TIMEPIECE STRIKING WORK

This application claims priority from European Patent Application No. 15168700.1 of May 21, 2015, the entire disclosure of which is hereby incorporated herein by reference.

FIELD OF THE INVENTION

The invention concerns a timepiece striking mechanism including control means arranged to be actuated by a timepiece movement or by a user in order to start a melody or striking sound, and melody selection means arranged to be actuated by a timepiece movement or by a user and including a selector mechanism comprising a main lever arranged to permit the movement of one specific control-piece in order to perform a specific melody or striking sound.

The invention also concerns a timepiece movement including at least one such striking mechanism.

The invention also concerns a watch or timepiece including at least one such striking mechanism.

The invention concerns the field of musical or striking timepieces, and more specifically watches.

BACKGROUND OF THE INVENTION

Watch striking or music mechanisms are complex, fragile mechanisms, and it is important to avoid simultaneously operating different functions, particularly to prevent the selection of several striking sounds or melodies, to modify the striking sound or melody selection when a striking sound or melody is being performed, or to start the performance of a striking sound or melody when a striking sound or melody is already being performed.

There exist protection mechanisms for minute repeaters, which are often complex, due to the complexity of the striking mechanism itself and to its dimensions.

EP Patent 2498148 dated 8 Mar. 2011 in the name of MONTRES BREGUET SA discloses a safety mechanism for preventing inadvertent actuation of the minute repeater control mechanism.

SUMMARY OF THE INVENTION

The invention proposes to safeguard a striking mechanism, in order to prevent failure of the mechanism.

To this end, the invention concerns a timepiece striking mechanism according to claim 1.

The invention also concerns a timepiece movement including at least one such striking mechanism.

The invention also concerns a watch or timepiece including at least one such striking mechanism.

BRIEF DESCRIPTION OF THE DRAWINGS

Other features and advantages of the invention will appear upon reading the following detailed description, with reference to the annexed drawings, in which:

FIG. 3 shows the melody selection means, and strike actuation means, in a rest position of the assembly.

FIG. 4 shows the assembly at rest.

FIG. 5 shows the melody selection.

FIG. 6 shows the locking of the melody selection on a first level.

FIG. 7 shows the locking of the melody selection on a second level.

FIG. 8 shows the drop of the first quarter-piece, while a second quarter-piece is shown in a position immediately preceding a stop position where it is locked on its locking lever.

FIG. 9 shows the drop of the second quarter-piece, while the first quarter-piece is shown in a position immediately preceding a stop position where it is locked on its locking lever, and FIG. 10 shows the corresponding safety position.

DETAILED DESCRIPTION OF PREFERRED EMBODIMENTS

Figure 1:
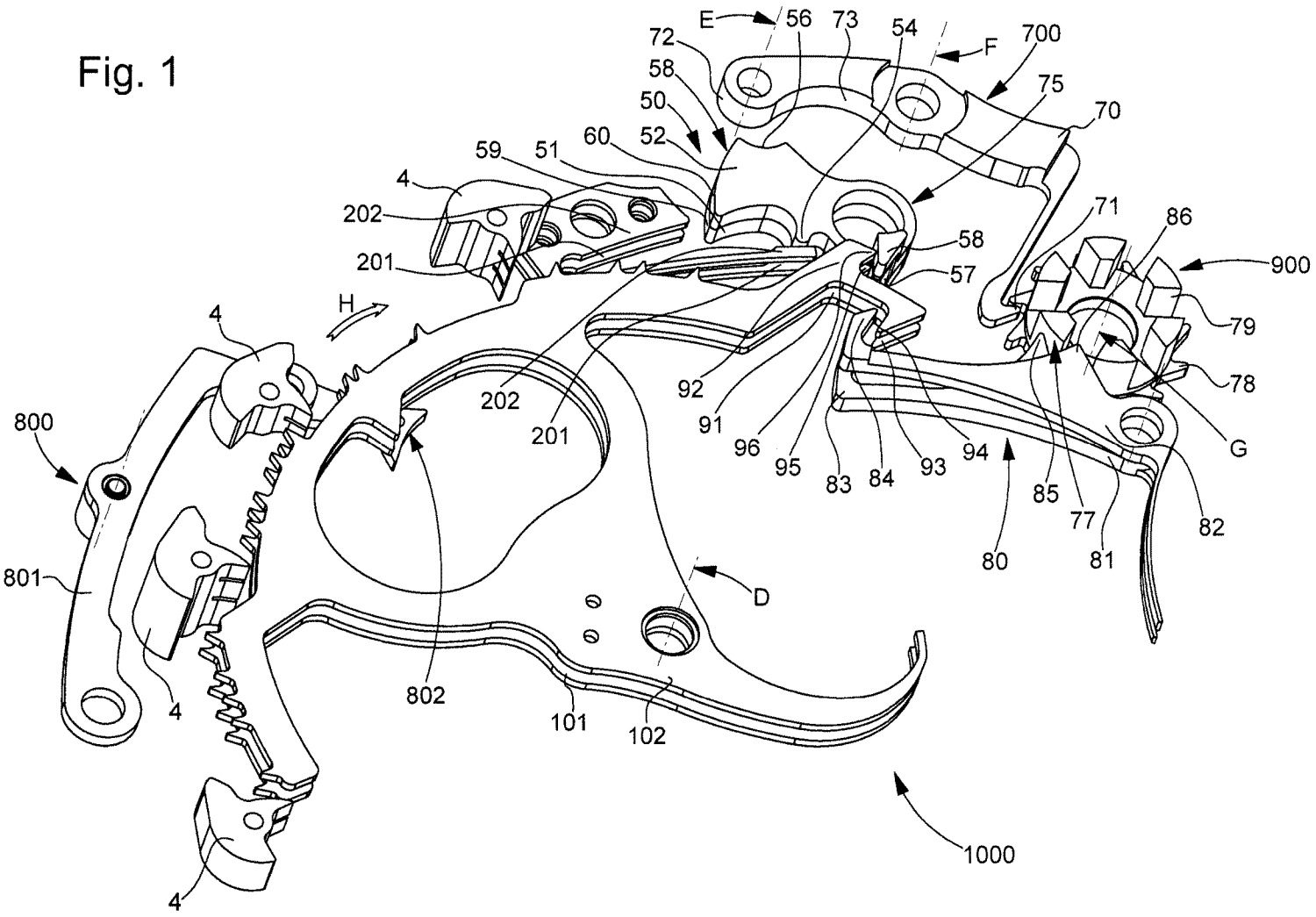
FIG. 1 shows a schematic perspective view of one part of a striking mechanism according to the invention, seen from above, in a specific, simplified application comprising two quarter-pieces, each arranged to perform a particular melody, melody selection means, and means for releasing the striking mechanism, and the safety mechanism associated with the invention for preventing the inadvertent selection or triggering of a melody when a quarter-piece is moving in order to perform a melody.
Figure 2:
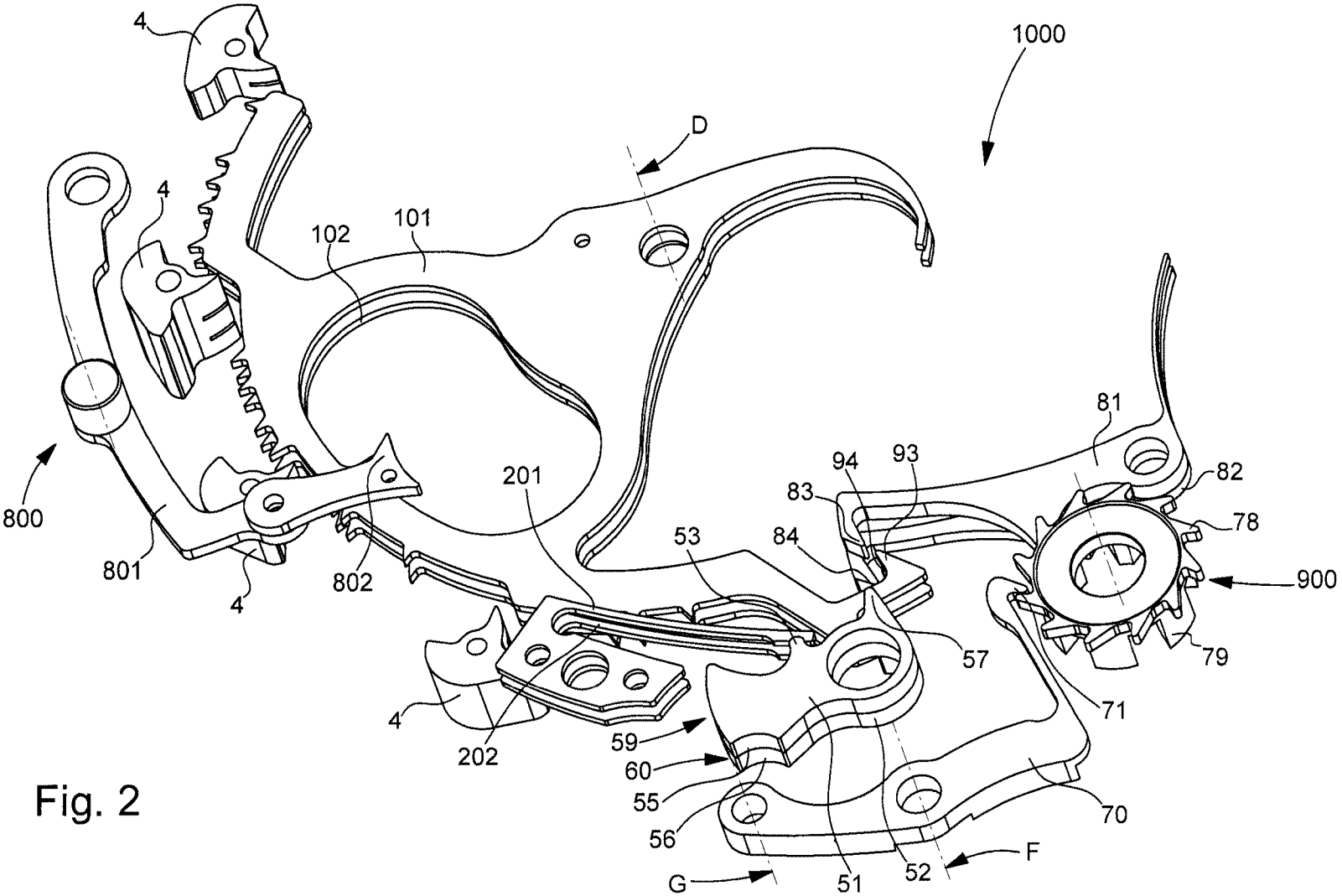
FIG. 2 shows, in the same manner, the same mechanism seen from below.

The invention concerns the protection of striking or musical mechanisms, and more specifically of strike and/or melody selection mechanisms, in particular according to EP Patent 141692.8 and CH Patent 0769/14 by the same Applicant, which are incorporated herein by reference.

The term "strike" will be used hereafter to designate both a striking mechanism and a mechanism for playing a melody. The term "striking sound" will be used hereafter to designate the sound played by both a striking mechanism and a mechanism for playing a melody.

The object is to prevent a user from selecting a striking sound or melody when the system is already performing a striking sound or melody, in order to prevent breakage or an error in the striking sound or melody.

As soon as the timepiece, described here in the particular and preferred case of a watch, starts to play (i.e. to produce an audible striking sound or melody), the mechanism according to the invention disables the selection control device, which will be operational again once the striking sound or melody has finished.

The melody or striking sound actuation control means is also disabled.

The Figures illustrate a simple device with only two control pieces which are a first quarter-piece 101 and a second quarter-piece 102, arranged to perform different striking sounds or melodies. The invention is generalizable to a greater number of control pieces, notably arranged in parallel planes as in the Figures, and which may also be arranged around a common selection member.

The Figures illustrate only one part of a striking mechanism 1000, whose components are known to those skilled in the art: selector means 700 comprising a push-piece 70 pivoting about an axis F and controlled by a lever (not shown) articulated on another axis E, to select a striking sound or melody, actuation control means 800 comprising a push-piece 801 for triggering, via a finger-piece 802, the performance of the strike and acting in a conventional manner on a detent ratchet or suchlike, these control pieces 101 and 102 are arranged to cooperate in a known manner with a plurality of gathering pallets 4, to control hammers or similar, as they pivot about an axis D, which in a non-limiting manner is a common axis here, and the safety mechanism according to the invention.

Naturally, the selection and actuation controls can be effected by the action of a user on a push-piece, or by a timepiece movement.

Thus, more specifically, the invention concerns a timepiece striking mechanism 100 including control means arranged to be actuated by a timepiece movement or by a user in order to start a melody or striking sound.

This striking mechanism 1000 also includes melody selection means 900, which are arranged to be actuated by a timepiece movement or by a user, and which include a main lever 70 arranged to permit the movement of one specific control piece 101,102 of a plurality of strike pieces, to perform a particular melody or striking sound.

According to the invention, striking mechanism 1000 includes a safety mechanism 50, which is arranged to prevent the selection or the actuation of a melody or striking sound when another melody or striking sound is already being performed.

This safety mechanism 50 includes, for each control piece 101, 102, a cam 51, respectively 52, which is associated with said control piece 101, 102 respectively, and which, when its respective control piece 101, 102 has started to perform a melody or striking sound, is arranged to prohibit the actuation of melody selection means 900, by immobilising main lever 70.

In particular, each cam 51, 52, of safety mechanism 50 includes a finger-piece 57, 58, for controlling the pivoting of the respective cam 51, 52 under the action of a beak 95, 96, comprised in the respective control piece 101, 102, when the respective control piece 101, 102 pivots.

Advantageously, each control piece 101, 102 includes hooking means 93, 94, which are arranged to cooperate, to immobilise the respective control piece 101, 102, with complementary hooking means 83, 84, comprised in a locking lever 81 82, whose pivoting, against elastic return means comprised in locking lever 82, 83, is controlled by that of the selector mechanisms which cooperate with said control piece 101, 102.

Figure 3:
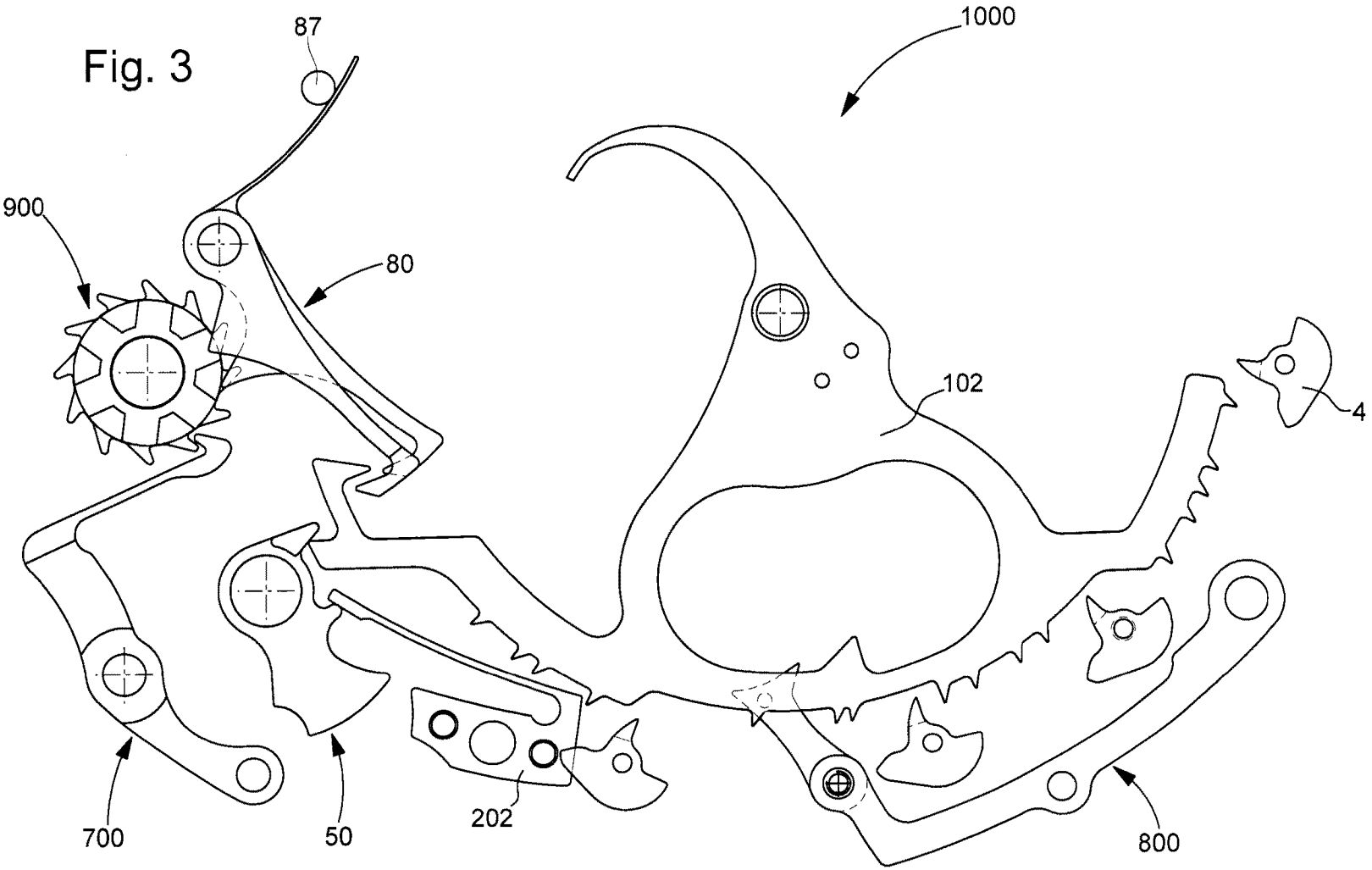
FIGS. 3 to 10 illustrate the same mechanism in plan and top views, wherein only
Figure 4:
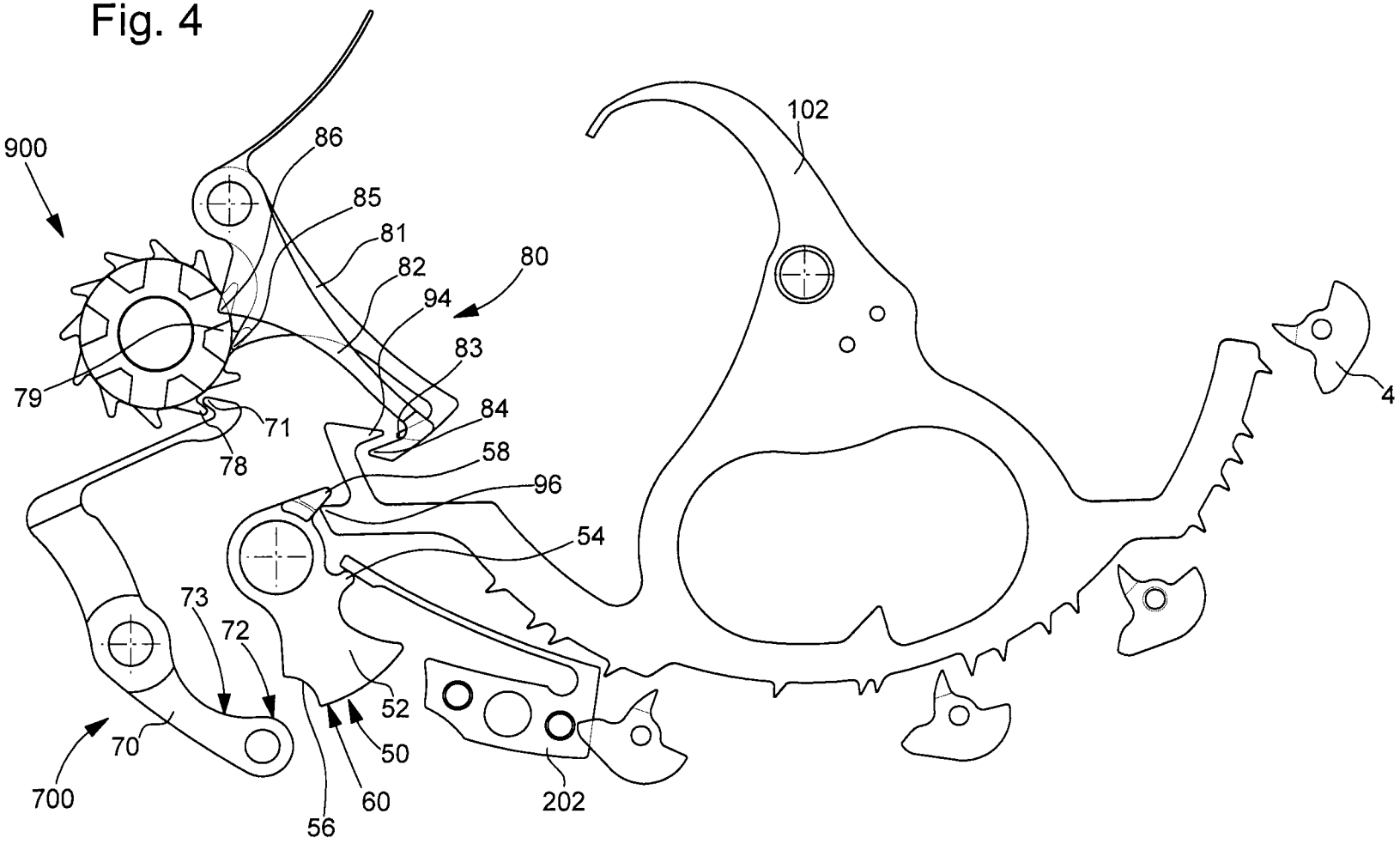
Figure 5:
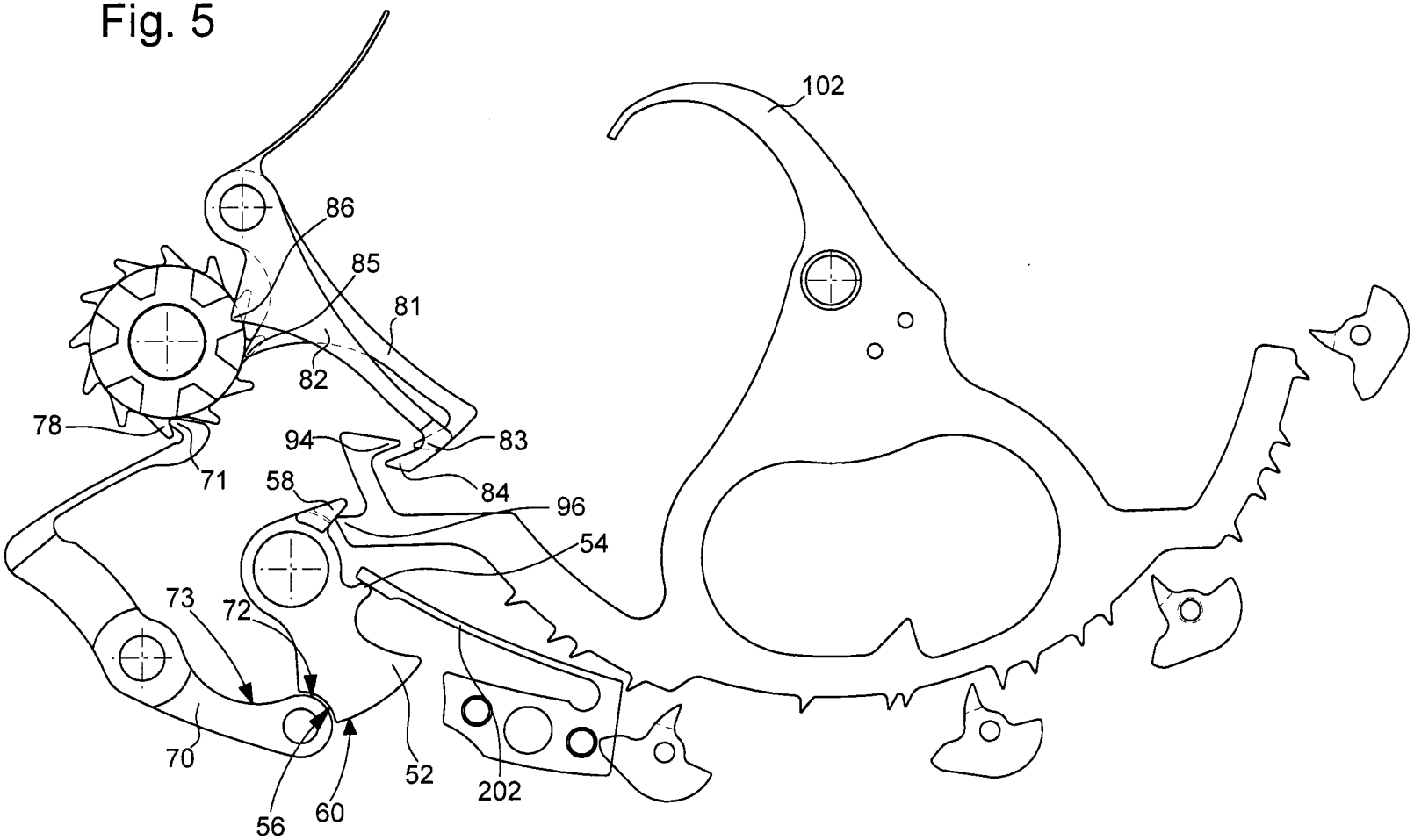
Figure 6:
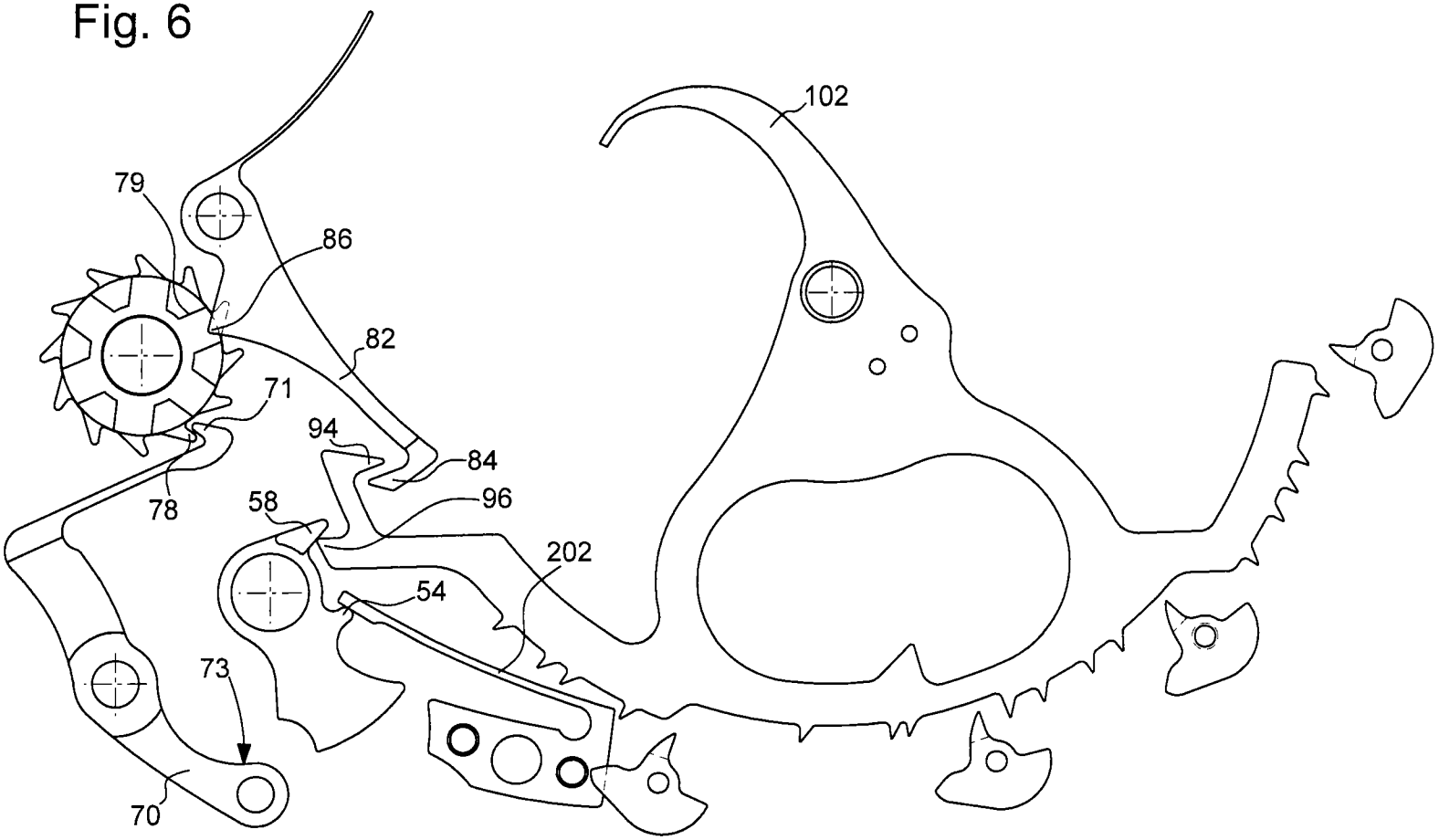
Figure 7:
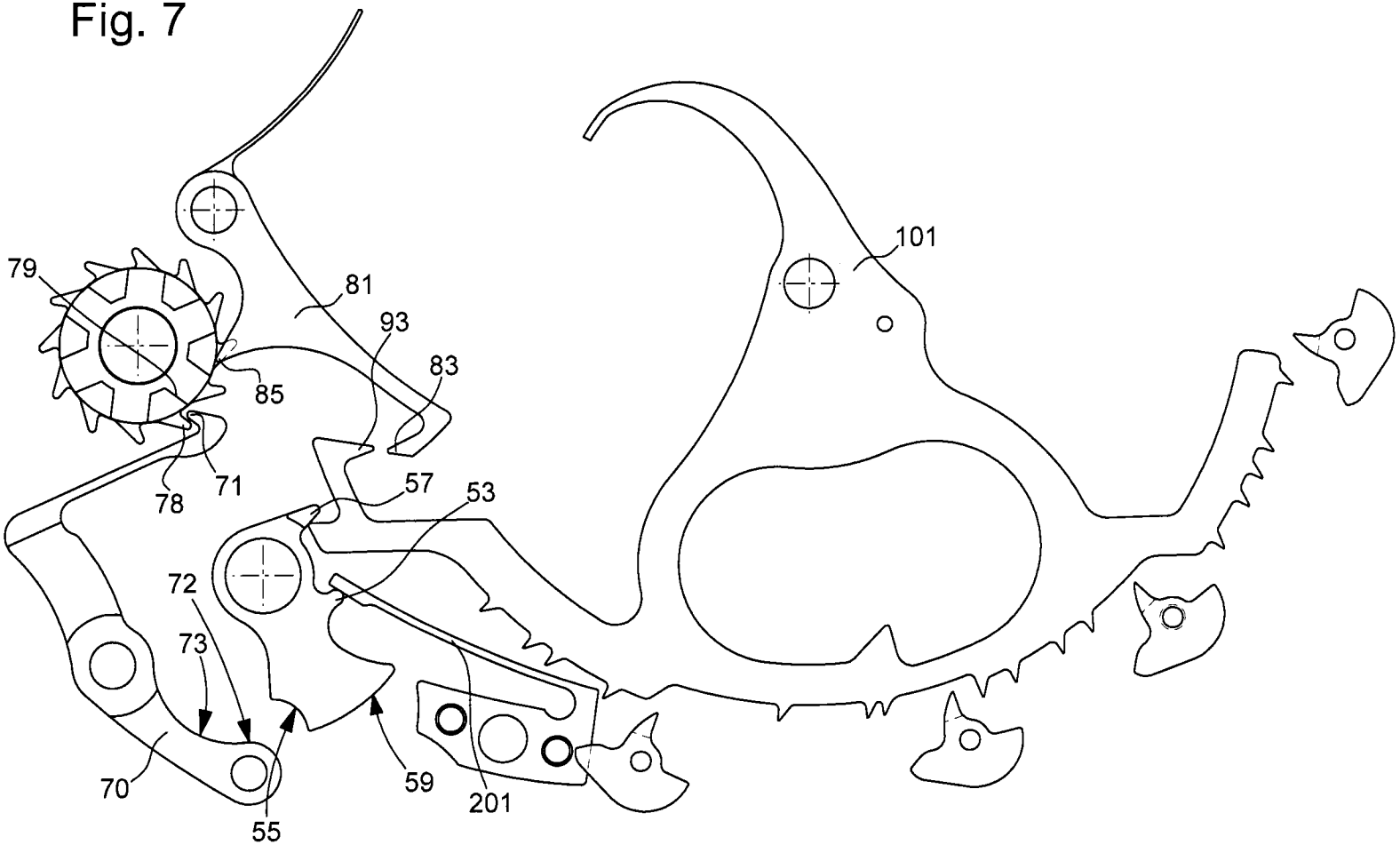
Figure 8:
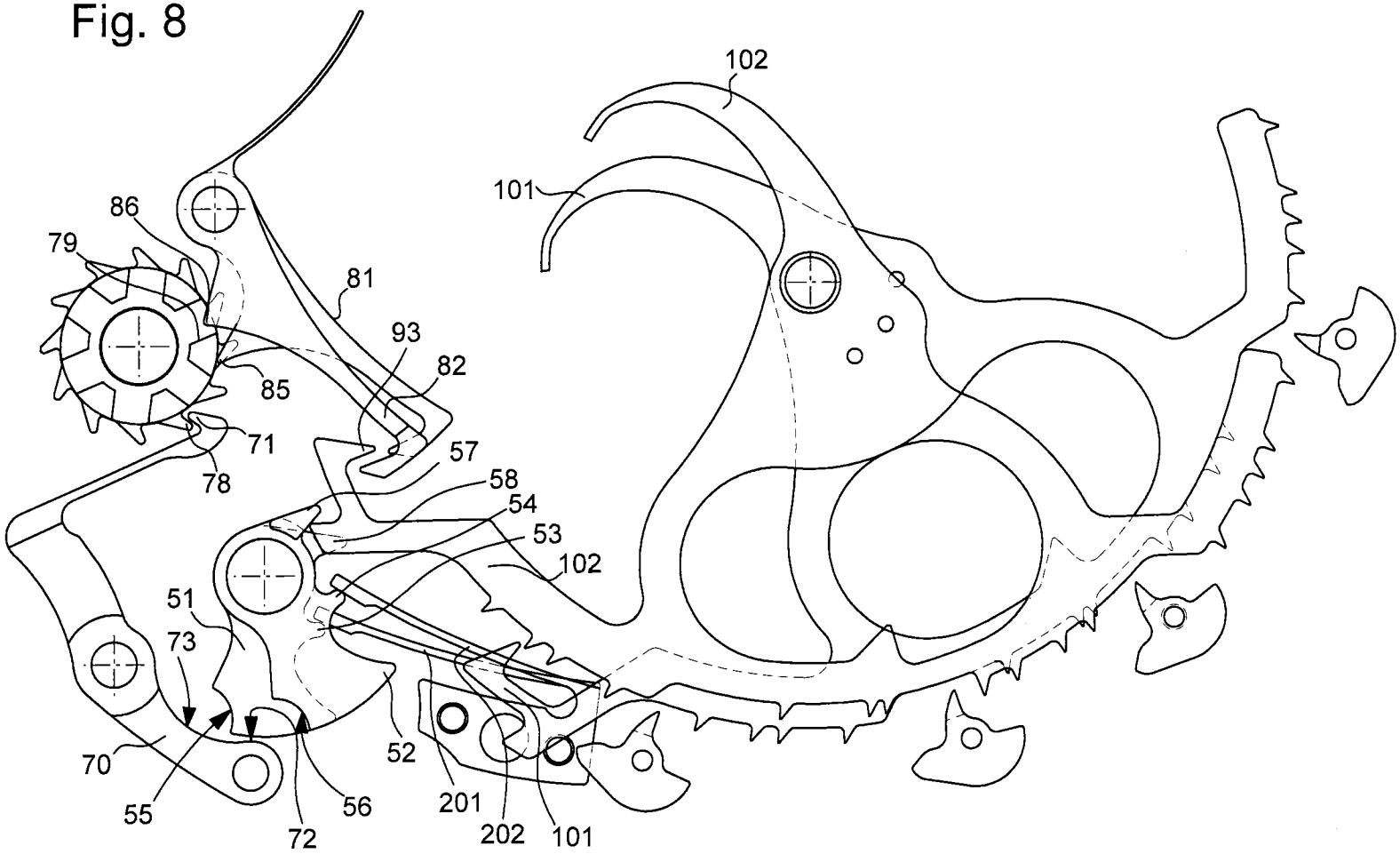
Figure 9:
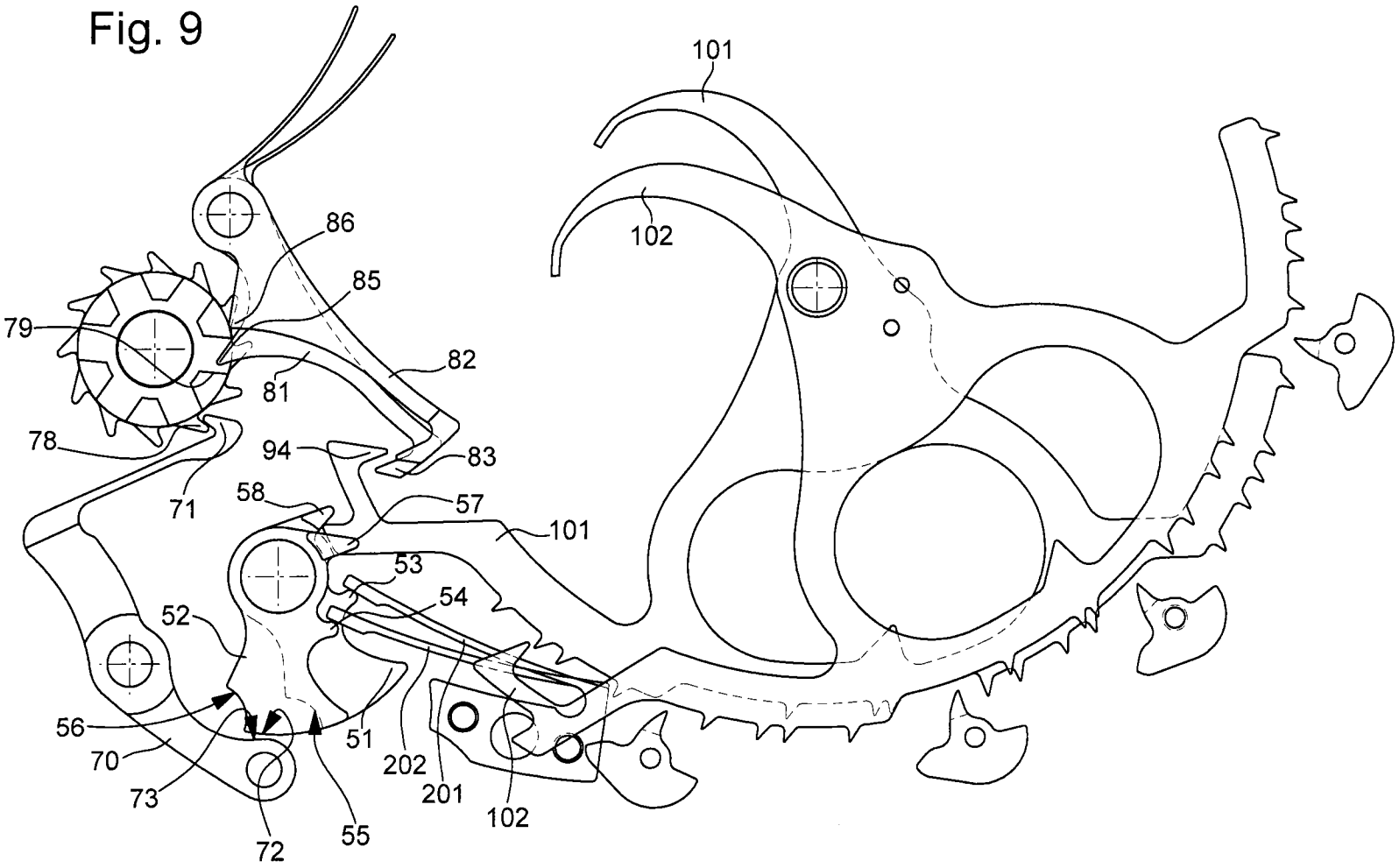
Figure 10:
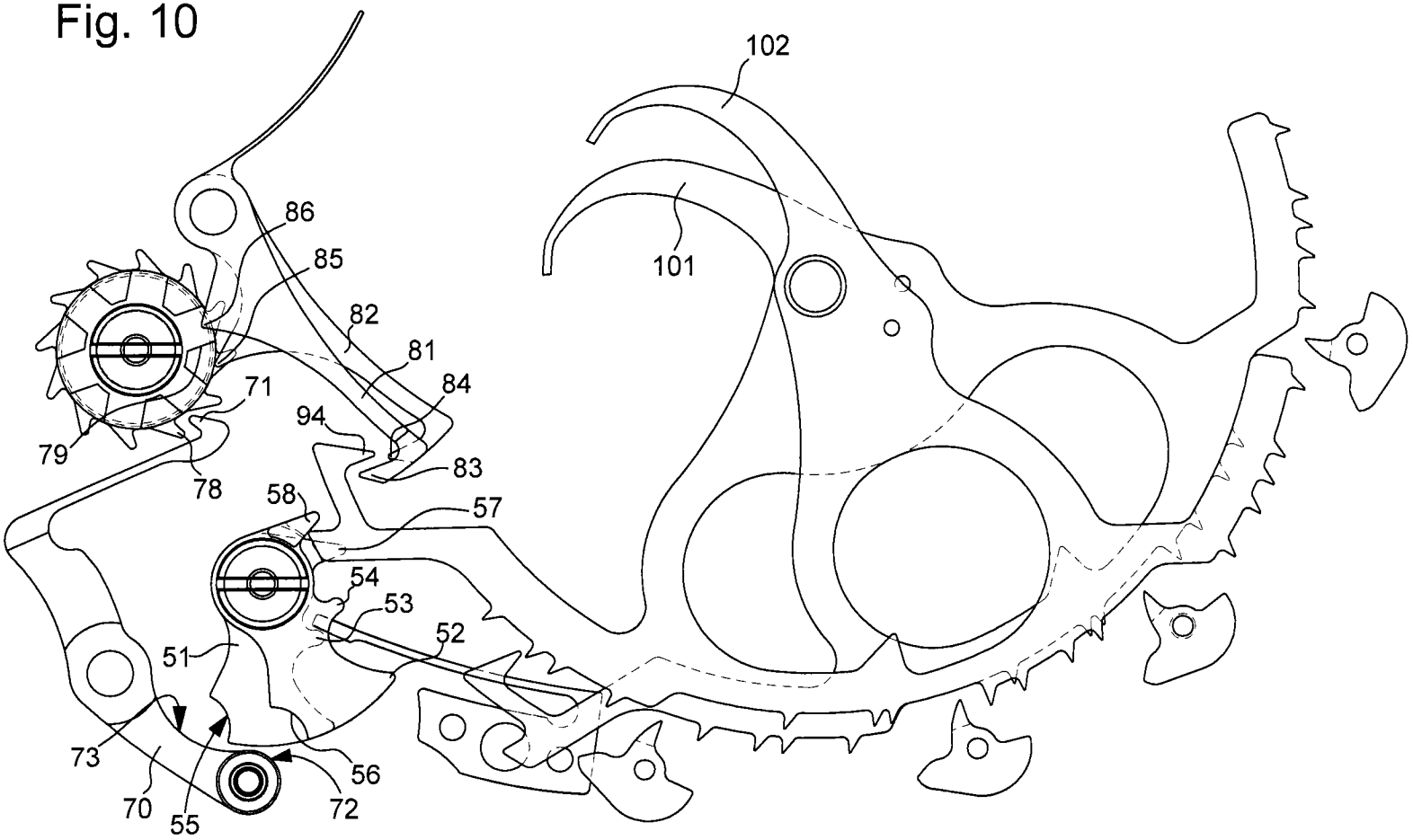

Thus, the end 91, 92 of each control piece 101, 102, on the side facing melody selection means 900, includes a finger-piece 95, 96 and a hook 93, 94. This end includes, behind hook 93, 93, a hollow arranged to house the complementary hook 83, 84 of the lever 81, 82 concerned. This is how the angular position of locking levers 81, 82 allows or prevents the pivoting of the corresponding control piece 101, 102. These locking levers 81, 82 advantageously also include, on the side opposite to complementary hooks 83, 84 with respect to their pivot axis, a spring arm arranged to abut on a pin 87 visible in FIG. 3. Each locking lever 81, 82 also includes a finger-piece 85, 86 arranged to cooperate with the pillars 79 of the column wheel, and locking levers 81, 82 are arranged such that the finger-piece of one rests on the peripheral portion of a column 79 when the other finger-piece 86, 85 of the other occupies the space between two consecutive pillars 79, closest to the pivot axis G of the column wheel.

In the non-limiting embodiment illustrated in the Figures, locking levers 81, 82 are superposed and each include a control finger-piece 85, 86.

The melody selection means 900 include, in an advantageous embodiment, at least one column wheel, whose pillars 79 are arranged to cooperate with all the control finger-pieces 85, 86 of locking levers 81, 82. Naturally, pillars 79 extend over the number of levels of the control levers, limited to two in the example of the Figures.

Preferably, each cam 51, 52 respectively, includes a boss 53, 54 respectively, which cooperates with a return spring 201, 202 respectively, associated with the respective cam 51, 52 to impart on cam 51, 52 respectively, a resistant torque which tends to resist the advance of the control piece 101, 102 concerned.

As seen in the Figures, each cam 51, 52 preferably includes a cylindrical female recess 55, 56, which is arranged to cooperate in a complementary manner with a cylindrical male boss 72 comprised in control lever 70, in order to prevent the pivoting of both cams in a strike correction phase.

Preferably, each cam 51, 52 includes a male cylindrical peripheral portion 59, 60, which is arranged to cooperate in a complementary manner with a female cylindrical surface 73 comprised in control lever 70, to prevent the pivoting of control lever 70 in the safety position and when control piece 101, 102 is advancing, while allowing the pivoting of the cam 51, 52 concerned.

In a simple embodiment illustrated in the Figures, control lever 70 includes an arm provided with a hook 71, which is arranged to cooperate in traction with teeth 78 comprised in an inclined toothing integral with melody selection means 900 and which forms, in the example of the Figures, the base of the column wheel. Strike selection is thus effected by pivoting the column wheel about its axis G, and causes the movement of locking levers 81, 82, to release or catch the respective control piece 101, 102.

The invention also concerns a timepiece movement 2000 including at least one such striking mechanism 1000.

The invention also concerns a watch 3000 or a timepiece including at least one such striking mechanism 1000.

The invention forms a simple, compact safety mechanism, which provides efficient protection for mechanisms that are often extremely expensive.

What is claimed is:

1. A timepiece striking mechanism comprising:

control means arranged to be actuated by a timepiece movement or by a user in order to start a melody or striking sound; and melody selection means arranged to be actuated by a timepiece movement or by a user and including a selector mechanism comprising a main lever arranged to allow the movement of a control piece in order to perform a specific melody or striking sound, wherein said striking mechanism includes a safety mechanism arranged to prevent the selection or the actuation of a melody or striking sound when a melody or striking sound is already being performed, wherein said safety mechanism comprises a single cam associated with said control piece, and wherein said cam is arranged to prevent the actuation of said melody selection means by immobilising said main lever when said control piece has started the performance of the melody or striking sound by abutting directly against said main lever.

2. The striking mechanism according to claim 1, wherein said cam, of said safety mechanism includes a finger-piece for controlling the pivoting of said respective cam under the action of a beak, comprised in said respective control piece, when said respective control piece pivots.

3. The striking mechanism according to claim 1, wherein said control piece includes hooking means, which are arranged to cooperate with complementary hooking means to immobilize said control piece, wherein said complementary hooking means are comprised in a locking lever, whose pivoting, against elastic return means comprised in said locking lever, is controlled by said selector mechanism which cooperates with said control piece.

4. The striking mechanism according to claim 3, wherein said locking lever includes a control finger-piece, and wherein said melody selection means include at least one column wheel whose pillars are arranged to cooperate with said control finger-piece of said locking lever.

5. The striking mechanism according to claim 1, wherein said cam includes a boss cooperating with a return spring associated with said cam to impart to said cam a resistant torque tending to resist the advance of said control piece concerned.

6. The striking mechanism according to claim 1, wherein said cam includes a cylindrical female recess, which is arranged to cooperate in a complementary manner with a cylindrical male boss comprised in said main lever, in order to prevent the pivoting of said cam in a strike correction phase.

7. The striking mechanism according to claim 1, wherein said cam includes a male cylindrical peripheral portion, which is arranged to cooperate in a complementary manner with a female cylindrical surface comprised in said main lever, to prevent the pivoting of said main lever in a safety position and during the advance of said control piece, while allowing the pivoting of said cam concerned.

8. The striking mechanism according to claim 1, wherein said main lever includes an arm provided with a hook arranged to cooperate in traction with the teeth of an inclined toothing integral with said melody selection means.

9. A timepiece movement including at least one striking mechanism according to claim 1.

10. A watch including at least one striking mechanism according to claim 1.

* * * * *